United States Patent [19]

Shattuck

[11] 4,150,985

[45] Apr. 24, 1979

[54] IMAGE FORMING PROCESS INVOLVING PHASE CHANGE

[75] Inventor: Meredith D. Shattuck, San Jose, Calif.

[73] Assignee: International Business Machines Corporation, Armonk, N.Y.

[21] Appl. No.: 777,224

[22] Filed: Mar. 14, 1977

Related U.S. Application Data

[63] Continuation-in-part of Ser. No. 532,356, Dec. 13, 1974, abandoned.

[51] Int. Cl.[2] ..... G03G 13/06; G03C 5/24

[52] U.S. Cl. ..... 96/1 R; 96/1.5 R; 96/48 R; 96/48 HD; 350/354

[58] Field of Search ..... 96/1 R, 1 PC, 1.1, 1 PS, 96/48 R, 48 HD; 350/353, 354

[56] References Cited

U.S. PATENT DOCUMENTS

| | | | |
|---|---|---|---|
| 3,266,045 | 8/1966 | Schaffert | 96/1.1 X |
| 3,307,941 | 3/1967 | Gundlach | 96/1.1 |
| 3,317,315 | 5/1967 | Nicoll et al. | 96/1.1 |
| 3,322,540 | 3/1967 | Giaimo | 96/1.1 |
| 3,329,500 | 7/1967 | Goffe | 96/1.1 |
| 3,408,181 | 10/1968 | Mammino | 96/1.1 |
| 3,413,117 | 11/1968 | Gaynor | 96/1.5 X |
| 3,436,216 | 4/1969 | Urbach | 96/1.1 |
| 3,450,533 | 6/1969 | Amidon et al. | 96/27 R |
| 3,475,170 | 10/1969 | Nicoll | 96/1.1 |
| 3,482,969 | 12/1969 | Ewing | 96/1.1 |
| 3,510,297 | 5/1970 | Herrick et al. | 96/105 |
| 3,519,422 | 7/1970 | Gaynor et al. | 96/1.1 X |
| 3,655,371 | 4/1972 | Chafaris | 96/1.1 |
| 3,672,883 | 6/1972 | Ciccarelli et al. | 96/1.1 |
| 3,672,886 | 6/1972 | Mammino | 96/1.1 |
| 3,723,113 | 3/1973 | Goffe | 96/1 PS |
| 3,791,826 | 2/1974 | Cherry et al. | 96/105 |
| 3,801,314 | 4/1974 | Goffe | 96/1 PS |
| 3,826,573 | 7/1974 | Heinzer | 96/1.1 |
| 3,861,914 | 1/1975 | Gange | 96/1.1 X |
| 3,961,948 | 6/1976 | Saeva | 96/1 R |

FOREIGN PATENT DOCUMENTS

| | | | |
|---|---|---|---|
| 568707 | 1/1959 | Canada | 96/1.5 |
| 1115245 | 5/1968 | United Kingdom | 96/101 |

OTHER PUBLICATIONS

Nicoll(2), "A New Surface Phenomenon in Thermoplastic Layers and its Use in Recording Information", *R.C.A. Review,* Jun. 1964, pp. 209–231.

*Primary Examiner*—Roland E. Martin, Jr.
*Attorney, Agent, or Firm*—Joseph G. Walsh

[57] ABSTRACT

An image is formed by exposing to a light pattern a plate comprising a substrate and only a single layer of a photoconductive, non-polymeric, film forming, pyrazoline, oxadiazoles or fluorenone organic compound which has a glass transition temperature below 200° C. and which has both a crystalline phase and an amorphous phase, and developing the plate by causing a selective change in phase between the light exposed and non-exposed areas.

7 Claims, No Drawings

IMAGE FORMING PROCESS INVOLVING PHASE CHANGE

This application is a continuation-in-part of copending application, Ser. No. 532,356, filed Dec. 13, 1974 now abandoned.

FIELD OF THE INVENTION

The present invention is concerned with a process for forming visible images. A visible image is formed utilizing the differences in appearance of light exposed and non-exposed areas of a plate containing a photoconductive organic material which has both a crystalline and an amorphous phase.

PRIOR ART

A very large number of image forming processes are known to the prior art, including processes described as electrophotography. It is, however, believed that the present process is different from all prior art processes in that we are unaware of any prior art process which is predicated upon the existence of a visible difference between a crystalline phase of an organic photoconductor and an amorphous phase of the same material.

SUMMARY OF THE INVENTION

According to the present invention, a plate is formed comprising a substrate and only a single layer of a pyrazoline, oxadiazole or fluorenone organic compound which simultaneously possesses several essential properties. The organic compound must be photoconductive. It must be non-polymeric, capable of forming films, have a glass transition temperature below 200° C., and must have both a crystalline phase and an amorphous phase.

In the process of the present invention, a plate comprising a substrate and only a single layer of the organic compound as described above is exposed to a light pattern. The plate is then developed by either of two methods, both of which involve causing a selective change in phase between the light exposed and non-exposed areas.

One method of development involves contacting the organic photoconductive compound with a liquid in which the organic compound is only slightly soluble. When the compound having the above-mentioned properties is so contacted by the liquid, a change in phase is obtained. That is to say, there is a change in either the light exposed or the non-exposed areas, either from a crystalline phase to an amorphous phase, or from an amorphous phase to a crystalline phase.

The organic compound may be present in the plate in a binder. In cases where a liquid in which the organic compound is only slightly soluble is used as part of the binder, the development process can be carried out by heating the plate. It is believed that this heating causes contact between the liquid and the organic photoconductive compound. Upon heating, a visible difference is observed between the light exposed and non-exposed areas.

In a preferred variation of the process of the present invention, the substrate is electrically conductive, and the plate is subjected to corona charging. By this method, enhanced sensitivity is obtained. The charging step should preferably take place prior to the exposure to the light pattern.

By use of the process of the present invention, a visible image is obtained which corresponds to the light pattern used during the light exposure step. This visible image has differential solubility, wetting and optical properties, which can be used to produce a variety of effects. The imaging characteristics of the process are characterized by very high resolution and also high photosensitivity. Photosensitivities on the order of about 10 microjoules/cm$^2$ have been obtained. The process also has continuous tone capability and capability for large area development. It has the additional advantage of being useful to obtain either positive or negative images on the same plate. Most particularly, its high resolution is extremely advantageous to micro processes.

As stated above, the plates of the present invention also demonstrate a difference in solubility. The crystal pattern on a developed plate can be used as a mask for further etching with, for example, a sodium hydroxide solution. The crystal pattern on a coating of a conductive substrate such as aluminized Mylar has been used to produce a selective etching of the aluminum. Thus, the coatings have photoresist properties. In addition, the surface properties of the crystalline-amorphous areas have been used to produce a selective inking, using a dye dissolved in an alcohol-hydrocarbon mixture in a duplicating master manner.

As mentioned previously, the plates of the present invention comprise a pyrazoline, oxadiazole or fluorenone organic compound having several required properties. It must be photoconductive. It must be non-polymeric and capable of forming films. It must have a glass transition temperature below 200° C. and must have both a crystalline and an amorphous phase. Routine testing can readily be used to determine the presence or absence of each of these properties. Many materials possess these properties. Particularly good results have been obtained using 1-phenyl-3-(p-diethylamino styryl) -5-(p-diethylamino phenyl) pyrazoline. Other useful materials include 2,5-bis-dimethylamino p-phenylene-1,3,5 oxadiazole, 1,3,5 triphenyl pyrazoline and 1-phenyl-3-p-piperidino-phenyl-5-[3-methyl-2-thienyl]-2-pyrazoline. Very good results have also been obtained using 2,4,7-trinitro-9-fluorenone.

The process of the present invention may be used employing any of the substrates known to the electrophotographic art. A preferred example is a film of Mylar. Mylar is polyethylene terephthalate. When so desired, the Mylar may be aluminized to form a preferred conductive substrate.

In one variation of the present invention, the plate is formulated with the organic compound present in a binder. Numerous binder materials are known to the prior art and are suitable for use in the present invention. The preferred material is Piccolastic A-75 which is a low molecular weight polystyrene based resin. Other particularly useful binder materials include Piccolastic D75, which is an intermediate molecular weight polystyrene based resin, Staybelite ester 5, which is a thermoplastic rosin from Hercules, and sucrose benzoate. The ratio of the organic material to the binder is not critical and, in fact, the use of a binder is not essential, but is merely one possible variation of the present invention.

In instances where a binder is used, a liquid in which the organic compound is only slightly soluble may be incorporated in the binder in another variation of the present invention. It is believed that this has a two-fold beneficial effect: (1) In such instances the subsequent development step may be accomplished simply by heating the plate. (2) The use of a binder lowers the glass transition temperature of the organic compound and the use of liquid in the binder produces a still additional lowering of the glass transition temperature. Liquids suitable for such use in the process of the present invention include paraffin oil, mineral oil and the like.

As mentioned above, a development step forms part of the present process. This development can be carried out by contacting the organic photoconductive compound with a liquid in which the organic compound is only slightly soluble. The liquid should not react chemically with the organic compound. Useful liquids include, for example, hydrocarbons. A preferred liquid is Sohio odorless solvent 3440 which is a kerosene hydrocarbon. Other useful liquids include, for example, naptha, ethanol and the like. The choice of solvent will depend upon the choice of organic compound.

In another variation of the process of the present invention, a plate may be used containing a barrier layer between the substrate and the organic photoconductive compound. In general, such a barrier layer will be about 1 micron or less in thickness and may be made of any of the materials previously known in the art for use as barrier layers. A preferred material is the acrylic resin Elvacite 2010. Other useful materials include polystyrene and polyvinyl pyrollidone.

The following Examples are given solely for purposes of illustration and are not to be considered limitations on the invention, many variations of which are possible without departing from the spirit or scope thereof.

EXAMPLE I

Formulation 1 part 1-phenyl-3-(p-diethylamino styryl) 5-(p-diethylamino phenyl) pyrazoline (DEASP)
1 part Piccolastic A-75 (low molecular weight polystyrene)
16 parts tetrahydrofuran The solution from above is coated in a single layer on aluminized Mylar to a thickness of about 1–2 microns.

The above-formulated plate was subjected to corona charging, which can be in either the positive or negative mode, and then imagewise exposed to light. Development took place using Sohio odorless solvent 3440.

EXAMPLE II

A single layer containing 1 part 2,4,7 trinito-9-fluorenone and 4 parts Staybelite Ester 5 was applied to the conductive surface of NESA glass. The coating thickness was approximately 10 microns. The coating was corona charged to a negative potential of about 150 volts using a Xerox Model D processor. After corona charging the plate was exposed 4 sec. to a projection image using a mercury arc lamp as a source and a negative transparency as the master. The latent image was developed by immersing the plate in Sohio 3440. With development a crystalline pattern appeared in the exposed areas with the background areas clear or amorphous.

EXAMPLE III

A single layer prepared as in Example II. The sample was exposed 4 sec. (without prior corona charging) and immersed in Sohio 3440. No image was observed. After a 2-minute exposure without prior corona charging, an image was obtained with Sohio development. In this case the exposed areas were amorphous and the background or unexposed areas were crystalline.

EXAMPLE IV

A coating was prepared by dissolving 2,4,7 trinito-9-fluorenone (TNF) in tetrahydrofuran and adding Staybelite ester 5 at a ratio of 1 part TNF to 2 parts Staybelite ester 5. The solution was applied to a glass slide and the solvent was allowed to evaporate. The single layer coating was exposed to light/dark pattern using a mercury arc source and a negative transparency as a master. After a 1-minute exposure the coating was heated to a temperature of about 120° C. An amorphous-crystalline image was obtained which corresponded to the light/dark exposure pattern.

EXAMPLE V

A coating was prepared as in Example IV. The coating was exposed 1 minute and developed by immersing in ethanol. The exposed areas were clear or amorphous while the unexposed areas were crystalline.

EXAMPLE VI 1-phenyl-3 p-piperidino phenyl-5-[3 methyl-2-thienyl]-2-pyrazoline was mixed with 1,4 polybutadiene in a toluene solution at a ratio of 5 parts pyrazoline compound to 1 part binder and was applied as a single layer on a glass slide. The coated slide was exposed while the coating contained some residual solvent. An amorphous to crystalline transition was obtained with exposure with the exposed areas remaining amorphous and the unexposed areas becoming crystalline.

EXAMPLE VII

When heat is used as the development step, it is preferable to incorporate a low melting resin and oil to lower the transition temperature. A typical formulation is as follows: 4 parts DEASP, 1 part Staybelite ester 5; 2.5 parts paraffin oil; 20 parts solvent. A thin film coated as a single layer from the above solution is corona charged negative to a surface potential of 100–200 volts and exposed to blue light ($\sim 10\ \mu/cm^2$) to form a latent image. Development is obtained by brief heating at about 80° C. The exposed areas become crystalline, while the unexposed areas remain amorphous or clear.

What is claimed is:

1. A process for forming a visible image consisting essentially of exposing to a light pattern a plate comprising an electrically conductive substrate and on said substrate only a single layer of a photoconductive, nonpolymeric, film-forming pyrazoline, oxadiazole, or fluorenone organic compound which has a glass transition temperature below 200° C., and which has both a crystalline phase and an amorphous phase, and developing the plate by causing a selective change in phase between the light exposed and non-exposed areas, said selective change in phase being either from the crystalline phase to the amorphous phase, or from the amorphous phase to the crystalline phase.

2. A process as claimed in claim 1 wherein the developing is accomplished by contacting the organic compound with a liquid in which the organic compound is only slightly soluble.

3. A process as claimed in claim 1 wherein the organic compound is in a binder.

4. A process as claimed in claim 3 wherein there is present in the binder a liquid in which the organic compound is only slightly soluble.

5. A process as claimed in claim 4 wherein the developing is accomplished by heating the plate.

6. A process as claimed in claim 1 wherein the plate is subjected to corona charging.

7. A process for forming a visible image consisting essentially of corona charging and exposing to a light pattern a plate comprising an electrically conductive substrate and on said substrate only a single layer of a photoconductive, non-polymeric, film-forming pyrazoline, oxadiazole, of fluorenone organic compound which has a glass transition temperature below 200° C., and which has both a crystalline phase and an amorphous phase, and developing the plate by contacting the organic compound with a liquid in which the organic compound is only slightly soluble, said developing causing a selective change in phase between the light exposed and non-exposed areas, said selective change in phase being either from the crystalline phase to the amorphous phase, or from the amorphous phase to the crystalline phase.

* * * * *